US009145660B2

(12) United States Patent
Peterson et al.

(10) Patent No.: US 9,145,660 B2
(45) Date of Patent: Sep. 29, 2015

(54) HYDRAULIC CONTROL SYSTEM HAVING OVER-PRESSURE PROTECTION

(71) Applicant: Caterpillar Inc., Peoria, IL (US)

(72) Inventors: Randal N. Peterson, Peoria, IL (US); Aleksandar M. Egelja, Naperville, IL (US); Rustu Cesur, Lombard, IL (US)

(73) Assignee: Caterpillar Inc., Peoria, IL (US)

( * ) Notice: Subject to any disclaimer, the term of this patent is extended or adjusted under 35 U.S.C. 154(b) by 469 days.

(21) Appl. No.: 13/714,017

(22) Filed: Dec. 13, 2012

(65) Prior Publication Data

US 2014/0060020 A1 Mar. 6, 2014

Related U.S. Application Data

(60) Provisional application No. 61/695,669, filed on Aug. 31, 2012.

(51) Int. Cl.
*E02F 9/22* (2006.01)
*F15B 11/042* (2006.01)
(Continued)

(52) U.S. Cl.
CPC ..... *E02F 9/2292* (2013.01); *E02F 9/226* (2013.01); *E02F 9/2235* (2013.01); *E02F 9/2242* (2013.01); *E02F 9/2296* (2013.01);
(Continued)

(58) Field of Classification Search
CPC ..... E02F 9/2235; E02F 9/2242; E02F 9/2296; E02F 9/2292; E02F 9/226; F16H 61/4017; F15B 11/0423; F15B 11/165; F15B 20/007; F15B 2211/20546; F15B 2211/251; F15B 2211/50536
See application file for complete search history.

(56) References Cited

U.S. PATENT DOCUMENTS 2,470,778 A 5/1949 Lankovski et al.
4,665,697 A 5/1987 Dantlgraber
(Continued)

FOREIGN PATENT DOCUMENTS

GB 889893 9/1960
JP 56-090159 7/1981
(Continued)

OTHER PUBLICATIONS

U.S. Appl. No. 13/718,938 of Rustu Cesur et al. entitled "Hydraulic Control System Having Electronic Flow Limiting" filed Dec. 18, 2012.
(Continued)

*Primary Examiner* — Nathaniel Wiehe
*Assistant Examiner* — Abiy Teka
(74) *Attorney, Agent, or Firm* — Finnegan, Henderson, Farabow, Garrett & Dunner, LLP

(57) ABSTRACT

A hydraulic control system for a machine is disclosed. The hydraulic control system may have a tank, a pump configured to draw fluid from the tank and pressurize the fluid, an actuator, and a control valve configured to direct fluid from the pump to the actuator and from the actuator to the tank to move the actuator. The hydraulic system may also have a main relief valve movable away from a closed position to pass pressurized fluid to the tank when a pressure of the fluid directed to the actuator exceeds a first threshold pressure, and a controller in communication with the pump. The controller may be configured to selectively reduce a displacement of the pump after the main relief valve has moved away from the closed position when the pressure of the fluid directed to the actuator exceeds a second threshold pressure.

20 Claims, 3 Drawing Sheets

(51) Int. Cl.
*F15B 20/00* (2006.01)
*F15B 21/04* (2006.01)

(52) U.S. Cl.
CPC ..... *F15B11/0423* (2013.01); *F15B 20/007* (2013.01); *F15B 21/042* (2013.01); *F15B 2211/20546* (2013.01); *F15B 2211/20576* (2013.01); *F15B 2211/2656* (2013.01); *F15B 2211/3052* (2013.01); *F15B 2211/30595* (2013.01); *F15B 2211/327* (2013.01); *F15B 2211/50536* (2013.01); *F15B 2211/62* (2013.01); *F15B 2211/6309* (2013.01); *F15B 2211/6346* (2013.01); *F15B 2211/6652* (2013.01); *F15B 2211/6658* (2013.01); *F15B 2211/7135* (2013.01); *F15B 2211/7142* (2013.01); *F15B 2211/85* (2013.01); *F15B 2211/8603* (2013.01); *F15B 2211/8606* (2013.01)

(56) References Cited

U.S. PATENT DOCUMENTS

| | | | | |
|---|---|---|---|---|
| 4,757,685 | A | 7/1988 | Burckhartzmeyer | |
| 5,067,321 | A | 11/1991 | Miyaoka | |
| 5,197,864 | A * | 3/1993 | Lunzman et al. | 417/218 |
| 5,575,148 | A | 11/1996 | Hirata et al. | |
| 5,622,226 | A | 4/1997 | Hausman et al. | |
| 5,630,316 | A | 5/1997 | Itsuji et al. | |
| 5,692,377 | A | 12/1997 | Moriya et al. | |
| 5,955,706 | A | 9/1999 | Fonkalsrud et al. | |
| 6,009,708 | A | 1/2000 | Miki et al. | |
| 6,058,343 | A | 5/2000 | Orbach et al. | |
| 6,094,911 | A | 8/2000 | Crawshaw | |
| 6,151,894 | A | 11/2000 | Endo et al. | |
| 6,275,757 | B1 | 8/2001 | Watanabe et al. | |
| 6,393,838 | B1 | 5/2002 | Moriya et al. | |
| 6,705,079 | B1 | 3/2004 | Tabor et al. | |
| 6,892,102 | B1 | 5/2005 | Fushimi | |
| 6,981,371 | B2 | 1/2006 | Imanishi et al. | |
| 7,059,125 | B2 | 6/2006 | Oka et al. | |
| 7,059,126 | B2 | 6/2006 | Ma | |
| 7,121,189 | B2 | 10/2006 | Vonderwell et al. | |
| 7,124,576 | B2 | 10/2006 | Cherney et al. | |
| 7,165,950 | B2 | 1/2007 | Fenny et al. | |
| 7,260,931 | B2 | 8/2007 | Egelja et al. | |
| 7,296,404 | B2 | 11/2007 | Pfaff | |
| 7,392,653 | B2 | 7/2008 | Sugano | |
| 7,487,707 | B2 | 2/2009 | Pfaff et al. | |
| 7,596,893 | B2 | 10/2009 | Tozawa et al. | |
| 7,748,279 | B2 | 7/2010 | Budde et al. | |
| 7,823,379 | B2 | 11/2010 | Hamkins et al. | |
| 7,908,852 | B2 | 3/2011 | Zhang et al. | |
| 7,934,329 | B2 | 5/2011 | Mintah et al. | |
| 7,979,181 | B2 | 7/2011 | Clark et al. | |
| 8,020,583 | B2 | 9/2011 | Christensen et al. | |
| 2004/0055455 | A1 | 3/2004 | Tabor et al. | |
| 2005/0081518 | A1 | 4/2005 | Ma et al. | |
| 2005/0129531 | A1 * | 6/2005 | Fenny et al. | 417/269 |
| 2009/0031720 | A1 | 2/2009 | Son | |
| 2009/0217653 | A1 | 9/2009 | Zhang et al. | |
| 2011/0020146 | A1 * | 1/2011 | Akiyama et al. | 417/213 |
| 2011/0173964 | A1 | 7/2011 | Takahashi et al. | |
| 2011/0302914 | A1 | 12/2011 | Helbling | |

FOREIGN PATENT DOCUMENTS

| | | |
|---|---|---|
| JP | 56-131802 | 10/1981 |
| JP | 60-215103 | 10/1985 |
| JP | 63-067403 | 3/1988 |
| JP | 63-167171 | 7/1988 |
| JP | 02-43419 | 2/1990 |
| JP | 03-69861 | 3/1991 |
| JP | 05-287774 | 11/1993 |
| JP | 10-103112 | 4/1998 |
| JP | 2000-213644 | 8/2000 |
| JP | 2004-125094 | 4/2004 |
| JP | 2005-003183 | 1/2005 |
| KR | 100290530 | 6/2001 |
| WO | 9627051 | 9/1996 |

OTHER PUBLICATIONS

U.S. Appl. No. 13/718,922 of Jiao Zhang et al. entitled "Hydraulic Control System Having Swing Motor Energy Recovery" filed Dec. 18, 2012.

U.S. Appl. No. 13/718,855 of Bryan J. Hillman et al. entitled "Hydraulic Control System Having Swing Motor Energy Recovery" filed Dec. 18, 2012.

U.S. Appl. No. 13/718,882 of Jiao Zhang et al. entitled "Hydraulic Control System Having Swing Motor Energy Recovery" filed Dec. 18, 2012.

U.S. Appl. No. 13/718,907 of Rustu Cesur et al. entitled "Hydraulic Control System Having Swing Energy Recovery" filed Dec. 18, 2012.

U.S. Patent Application of Tonglin Shang et al. entitled "Hydraulic Control System Having Swing Oscillation Dampening" filed Dec. 13, 2012.

U.S. Patent Application of Rustu Cesur et al. entitled "Adaptive Work Cycle Control System" filed Dec. 13, 2012.

U.S. Appl. No. 13/170,960 of Pengfei Ma et al. entitled "Hydraulic Control System Having Energy Recovery Kit" filed Jun. 28, 2011.

U.S. Appl. No. 13/171,007 of Pengfei Ma et al. entitled "Hydraulic Control System Having Swing Energy Recovery" filed Jun. 28, 2011.

U.S. Appl. No. 13/171,047 of Jiao Zhang et al. entitled "Hydraulic Control System Having Swing Motor Energy Recovery" filed Jun. 28, 2011.

U.S. Appl. No. 13/171,110 of Jiao Zhang et al. entitled "Hydraulic Control System Having Swing Motor Energy Recovery" filed Jun. 28, 2011.

U.S. Appl. No. 13/171,146 of Jiao Zhang et al. entitled "Energy Recovery System Having Accumulator and Variable Relief" filed Jun. 28, 2011.

* cited by examiner

HYDRAULIC CONTROL SYSTEM HAVING OVER-PRESSURE PROTECTION

RELATED APPLICATIONS

This application is based on and claims the benefit of priority from U.S. Provisional Application No. 61/695,669, filed Aug. 31, 2012, the contents of which are expressly incorporated herein by reference.

TECHNICAL FIELD

The present disclosure relates generally to a hydraulic control system and, more particularly, to a hydraulic control system having over-pressure protection.

BACKGROUND

Machines such as excavators, loaders, dozers, motor graders, and other types of heavy equipment use one or more actuators supplied with hydraulic fluid from a pump on the machine to accomplish a variety of tasks. These actuators are typically velocity controlled based on an actuation position of an operator interface device. For example, an operator interface device such as a joystick, a pedal, or another suitable device may be movable to generate a signal indicative of a desired velocity of an associated hydraulic actuator. When an operator moves the interface device, the operator expects the hydraulic actuator to move at an associated predetermined velocity.

In some situations, it may be possible for a pressure of the fluid supplied to the actuator(s) to exceed a desired level. This over-pressure situation can occur, for example, when work tool movement becomes stalled (e.g., when the work tool strikes against an immovable object). In these situations, the actuator or other components of the associated system can malfunction or be damaged. Accordingly, care should be taken to avoid such occurrences.

Conventionally, over-pressure situations are dealt with in one of two different ways. First, a main pressure relief valve associated with the system can open when system pressure exceeds a desired pressure. High-pressure fluid from the system is then dumped through the open valve into a low-pressure tank, thereby reducing the pressure of the system. Although effective, this strategy can be inefficient, as the dumped fluid contains significant energy that is wasted. At the same time, the wasted energy is dissipated in the form of heat, which creates a cooling issue itself. The second way to deal with high-pressure is to implement a pump control strategy known as high-pressure cutout, which automatically reduces pump output upon detection of an over-pressure situation. The reduction in pump output allows for a corresponding reduction in system pressure as the pressurized fluid within the system is consumed. Although also effective, high-pressure cutout can cause a sudden and unexpected drop in power. In addition, high-pressure cutout, by itself, may not be responsive enough to ensure that harmful over-pressure spikes do not occur.

In some situations, a main relief valve may be used together with a high-pressure cutout strategy. Specifically, the pump can be controlled to reduce power as system pressures increase and, when the system pressures further increase and exceed a desired level, a main relief valve can open to protect system components from damaging extremes. This strategy, however, may still cause a drop in power that is unexpected and undesired by the operator.

The disclosed hydraulic control system is directed to overcoming one or more of the problems set forth above and/or other problems of the prior art.

SUMMARY

One aspect of the present disclosure is directed to a hydraulic control system. The hydraulic control system may include a tank, a pump configured to draw fluid from the tank and pressurize the fluid, an actuator, and a control valve configured to selectively direct fluid from the pump to the actuator and from the actuator to the tank to move the actuator. The hydraulic system may also have a main relief valve movable away from a closed position to pass pressurized fluid to the tank when a pressure of the fluid directed to the actuator exceeds a first threshold pressure, and a controller in communication with the pump. The controller may be configured to selectively reduce a displacement of the pump after the main relief valve has moved away from the closed position when the pressure of the fluid directed to the actuator exceeds a second threshold pressure.

Another aspect of the present disclosure is directed to a method of operating a hydraulic control system. The method may include pressurizing a fluid with a pump, and directing pressurized fluid from the pump to an actuator and draining fluid from the actuator to move the actuator. The method may further include moving a main relief valve away from a closed position when a pressure of fluid at the actuator exceeds a first threshold pressure, and reducing a displacement of the pump after the main relief valve has moved away from the closed position when the pressure of the fluid at the actuator exceeds a second threshold pressure.

DETAILED DESCRIPTION

Figure 1:
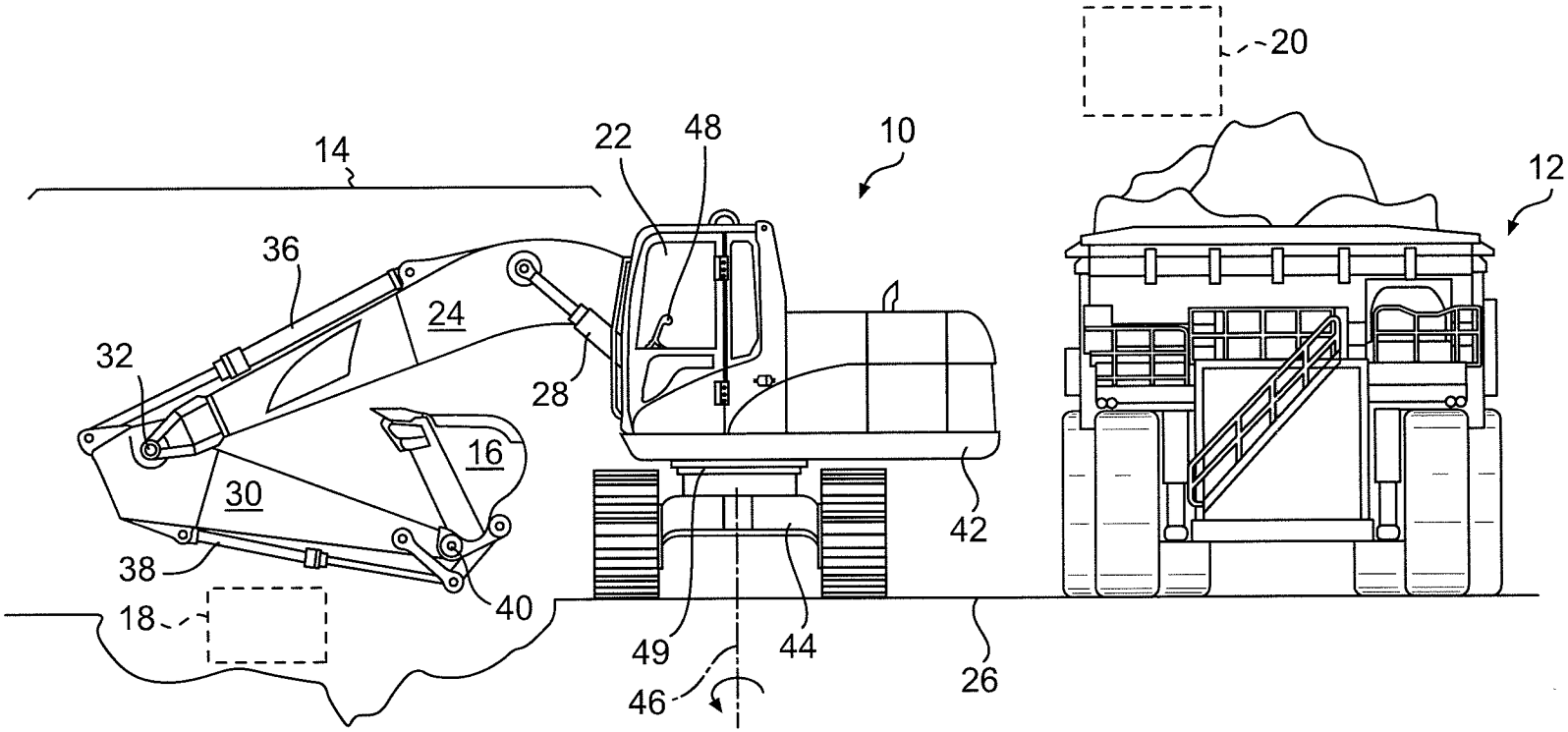
FIG. 1 is a diagrammatic illustration of an exemplary disclosed machine in a working environment.

FIG. 1 illustrates an exemplary machine 10 having multiple systems and components that cooperate to excavate and load earthen material onto a nearby haul vehicle 12. In the depicted example, machine 10 is a hydraulic excavator. It is contemplated, however, that machine 10 could alternatively embody another type of excavation or material handling machine, such as a backhoe, a front shovel, a motor grader, a dozer, or another similar machine. Machine 10 may include, among other things, an implement system 14 configured to move a work tool 16 between a dig location 18 within a trench or at a pile, and a dump location 20, for example over haul vehicle 12. Machine 10 may also include an operator station 22 for manual control of implement system 14. It is contemplated that machine 10 may perform operations other than truck loading, if desired, such as craning, trenching, material handling, bulk material removal, grading, dozing, etc.

Implement system 14 may include a linkage structure acted on by fluid actuators to move work tool 16. Specifically, implement system 14 may include a boom 24 that is vertically pivotal relative to a work surface 26 by a pair of adjacent, double-acting, hydraulic cylinders 28 (only one shown in FIG. 1). Implement system 14 may also include a stick 30 that is vertically pivotal about a horizontal pivot axis 32 relative to boom 24 by a single, double-acting, hydraulic cylinder 36. Implement system 14 may further include a single, double-acting, hydraulic cylinder 38 that is operatively connected to work tool 16 to tilt work tool 16 vertically about a horizontal pivot axis 40 relative to stick 30. Boom 24 may be pivotally connected to a frame 42 of machine 10, while frame 42 may be pivotally connected to an undercarriage member 44 and swung about a vertical axis 46 by a swing motor 49. Stick 30 may pivotally connect work tool 16 to boom 24 by way of pivot axes 32 and 40. It is contemplated that a different number and/or type of fluid actuators may be included within implement system 14 and connected in a manner other than described above, if desired.

Numerous different work tools 16 may be attachable to a single machine 10 and controllable via operator station 22. Work tool 16 may include any device used to perform a particular task such as, for example, a bucket, a fork arrangement, a blade, a shovel, a crusher, a shear, a grapple, a grapple bucket, a magnet, or any other task-performing device known in the art. Although connected in the embodiment of FIG. 1 to lift, swing, and tilt relative to machine 10, work tool 16 may alternatively or additionally rotate, slide, extend, open and close, or move in another manner known in the art.

Operator station 22 may be configured to receive input from a machine operator indicative of a desired work tool movement. Specifically, operator station 22 may include one or more interface devices 48 embodied, for example, as single or multi-axis joysticks located proximal an operator seat (not shown). Interface devices 48 may be proportional-type controllers configured to position and/or orient work tool 16 by producing work tool position signals that are indicative of a desired work tool speed and/or force in a particular direction. The position signals may be used to actuate any one or more of hydraulic cylinders 28, 36, 38 and/or swing motor 49. It is contemplated that different interface devices may alternatively or additionally be included within operator station 22 such as, for example, wheels, knobs, push-pull devices, switches, pedals, and other devices known in the art.

Figure 2:
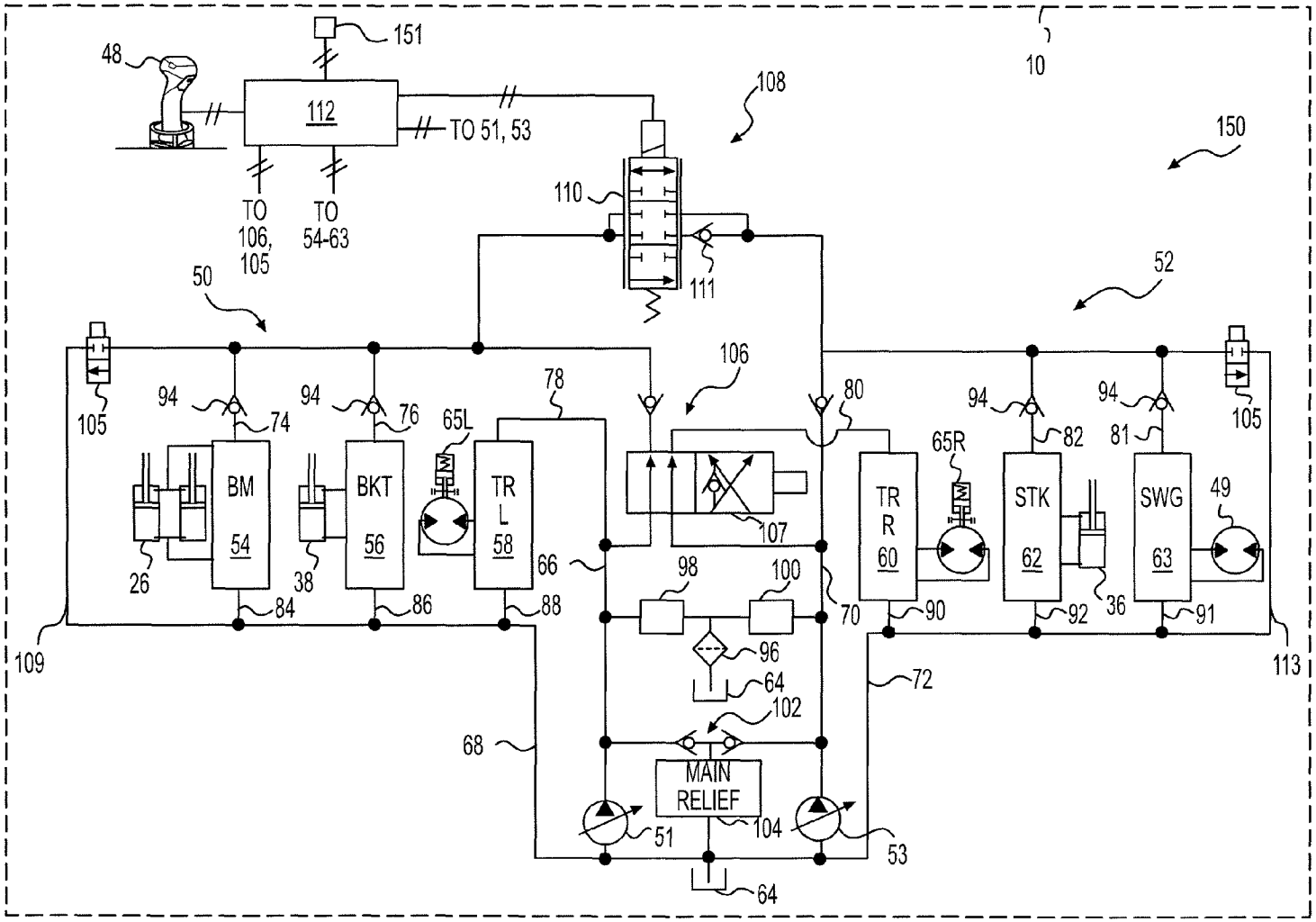
FIG. 2 is a schematic illustration of an exemplary disclosed hydraulic control system that may be used with the machine of FIG. 1.

As illustrated in FIG. 2, machine 10 may include a hydraulic control system 150 having a plurality of fluid components that cooperate to move work tool 16 (referring to FIG. 1) and machine 10. In particular, hydraulic control system 150 may include a first circuit 50 configured to receive a first stream of pressurized fluid from a first source 51, and a second circuit 52 configured to receive a second stream of pressurized fluid from a second source 53. First circuit 50 may include a boom control valve 54, a bucket control valve 56, and a left travel control valve 58 connected to receive the first stream of pressurized fluid in parallel. Second circuit 52 may include a right travel control valve 60, a stick control valve 62, and a swing control valve 63 connected in parallel to receive the second stream of pressurized fluid. It is contemplated that additional control valve mechanisms may be included within first and/or second circuits 50, 52 such as, for example, one or more attachment control valves and other suitable control valve mechanisms.

First and second sources 51, 53 may draw fluid from one or more tanks 64 and pressurize the fluid to predetermined levels. Specifically, each of first and second sources 51, 53 may embody a pumping mechanism such as, for example, a variable displacement pump (shown in FIG. 2), a fixed displacement pump, or another source known in the art. First and second sources 51, 53 may each be separately and drivably connected to a power source (not shown) of machine 10 by, for example, a countershaft (not shown), a belt (not shown), an electrical circuit (not shown), or in any other suitable manner. Alternatively, each of first and second sources 51, 53 may be indirectly connected to the power source via a torque converter, a reduction gear box, or in another suitable manner. First source 51 may produce the first stream of pressurized fluid independent of the second stream of pressurized fluid produced by second source 53. The first and second streams of pressurized fluids may be at different pressure levels and/or flow rates.

Tank 64 may constitute a reservoir configured to hold a supply of fluid. The fluid may include, for example, a dedicated hydraulic oil, an engine lubrication oil, a transmission lubrication oil, or any other fluid known in the art. One or more hydraulic systems within machine 10 may draw fluid from and return fluid to tank 64. It is contemplated that hydraulic control system 150 may be connected to multiple separate fluid tanks or to a single tank.

Each of boom, bucket, left travel, right travel, stick, and swing control valves 54-63 may regulate the motion of their related fluid actuators. Specifically, boom control valve 54 may have elements movable to control the motion of hydraulic cylinders 28 associated with boom 24; bucket control valve 56 may have elements movable to control the motion of hydraulic cylinder 38 associated with work tool 16; and stick control valve 62 may have elements movable to control the motion of hydraulic cylinder 36 associated with stick 30. Likewise, left and right travel control valves 58, 60 may have valve elements movable to control the motion of left and right travel motors 65L, 65R (shown only in FIG. 2-associated with traction devices of machine 10); and swing control valve 63 may have elements movable to control the swinging motion of swing motor 49.

The control valves of first and second circuits 50, 52 may be connected to allow pressurized fluid to flow into and drain from their respective actuators via common passageways. Specifically, the control valves of first circuit 50 may be connected to first source 51 by way of a first common supply passageway 66, and to tank 64 by way of a first common drain passageway 68. The control valves of second circuit 52 may be connected to second source 53 by way of a second common supply passageway 70, and to tank 64 by way of a second common drain passageway 72. Boom, bucket, and left travel control valves 54-58 may be connected in parallel to first common supply passageway 66 by way of individual fluid passageways 74, 76, and 78, respectively, and in parallel to first common drain passageway 68 by way of individual fluid passageways 84, 86, and 88, respectively. Similarly, right travel, stick, and swing control valves 60, 62, 63 may be connected in parallel to second common supply passageway 70 by way of individual fluid passageways 80, 82, and 81 respectively, and in parallel to second common drain passageway 72 by way of individual fluid passageways 90, 92, and 91, respectively. A check valve 94 may be disposed within each of fluid passageways 74, 76, 82, and 81 to provide for unidirectional supply of pressurized fluid to control valves 54, 56, 62, and 63, respectively.

Because the elements of boom, bucket, left travel, right travel, stick, and swing control valves 54-63 may be similar and function in a related manner, only the operation of boom control valve 54 will be discussed in this disclosure. In one example, boom control valve 54 may include a first chamber supply element (not shown), a first chamber drain element (not shown), a second chamber supply element (not shown), and a second chamber drain element (not shown). The first and second chamber supply elements may be connected in parallel with fluid passageway 74 to fill respective chambers of hydraulic cylinders 28 with fluid from first source 51, while the first and second chamber drain elements may be connected in parallel with fluid passageway 84 to drain the respective chambers of fluid. To extend hydraulic cylinders 28, the first chamber supply element may be moved to allow the pressurized fluid from first source 51 to fill the first chambers of hydraulic cylinders 28 with pressurized fluid via fluid passageway 74, while the second chamber drain element may be moved to drain fluid from the second chambers of hydraulic cylinders 28 to tank 64 via fluid passageway 84. To move hydraulic cylinders 28 in the opposite direction, the second chamber supply element may be moved to fill the second chambers of hydraulic cylinders 28 with pressurized fluid, while the first chamber drain element may be moved to drain fluid from the first chambers of hydraulic cylinders 28. It is contemplated that both the supply and drain functions may alternatively be performed by a single element associated with the first chamber and a single element associated with the second chamber, or by a single element that controls all filling and draining functions of hydraulic cylinders 28.

The supply and drain elements of each control valve may be solenoid movable against a spring bias in response to a command. In particular, hydraulic cylinders 28, 36, 38, left and right travel motors 65L, 65R, and swing motor 49 may move at velocities that correspond to the flow rates of fluid into and out of corresponding pressure chambers and with forces that correspond with pressure differentials between the chambers. To achieve the operator-desired velocity indicated via the interface device position signal, a command based on an assumed or measured pressure may be sent to the solenoids (not shown) of the supply and drain elements that causes them to open an amount corresponding to the necessary flow rate. The command may be in the form of a flow rate command or a valve element position command.

The common supply and drain passageways of first and second circuits 50, 52 may be interconnected for makeup and relief functions. In particular, first and second common supply passageways 66, 70 may receive makeup fluid from tank 64 by way of a common filter 96 and first and second bypass elements 98, 100, respectively. As the pressure of the first or second streams of pressurized fluid drops below a predetermined level, fluid from tank 64 may be allowed to flow into first and second circuits 50, 52 by way of common filter 96 and first or second bypass elements 98, 100, respectively. In addition, first and second common drain passageways 68, 72 may relieve fluid from first and second circuits 50, 52 to tank 64. In particular, as fluid within first or second circuits 50, 52 exceeds a predetermined pressure level, fluid from the circuit having the excessive pressure may drain to tank 64 by way of a shuttle valve 102 and a common main relief element 104.

Main relief element 104 may be a hydro-mechanical valve movable to any position between a fully open flow-passing position and a fully closed flow-blocking position. In the exemplary disclosed embodiment, main relief element 104 may be in the fully open position when a pressure of flowing through shuttle valve 102 reaches about 37 MPa or higher, and in the closed position when the pressure is about 34 MPa or lower.

A straight travel valve 106 may selectively rearrange left and right travel control valves 58, 60 into a parallel relationship with each other. In particular, straight travel valve 106 may include a valve element 107 movable from a neutral position toward a straight travel position. When valve element 107 is in the neutral position, left and right travel control valves 58, 60 may be independently supplied with pressurized fluid from first and second sources 51, 53, respectively, to control the left and right travel motors 65L, 65R separately. When valve element 107 is in the straight travel position, however, left and right travel control valves 58, 60 may be connected in parallel to receive pressurized fluid from only first source 51 for dependent movement. The dependent movement of left and right travel motors 65L, 65R may function to provide substantially equal rotational speeds of opposing left and right tracks (referring to FIG. 1), thereby propelling machine 10 in a straight direction.

When valve element 107 of straight travel valve 106 is moved to the straight travel position, fluid from second source 53 may be substantially simultaneously directed via valve element 107 through both first and second circuits 50, 52 to drive hydraulic cylinders 28, 36, 38. The second stream of pressurized fluid from second source 53 may be directed to hydraulic cylinders 28, 36, 38 of both first and second circuits 50, 52 because all of the first stream of pressurized fluid from first source 51 may be nearly completely consumed by left and right travel motors 65L, 65R during straight travel of machine 10. It should be appreciated that hydraulic control system 150 may alternatively be arranged in a complimentary manner, with respect to straight travel valve 106, such that when valve element 107 is in the straight travel position, left and right travel control valves 58, 60 may be connected in parallel to receive pressurized fluid from only second source 53, while fluid from first source 51 may be substantially simultaneously directed via valve element 107 through both first and second circuits 50, 52 to boom, bucket, stick, and swing control valves 54, 56, 62, 63.

A combiner valve 108 may selectively combine the first and second streams of pressurized fluid from first and second common supply passageways 66, 70 for high speed movement of one or more fluid actuators. In particular, combiner valve 108 may include a valve element 110 movable between a unidirectional open or flow-passing position (lower position shown in FIG. 2), a closed or flow-blocking position (middle position), and a bidirectional open or flow-passing position (upper position). When in the unidirectional open position, fluid from first circuit 50 may be allowed to flow into second circuit 52 (e.g., through a check valve 111) in response to the pressure of first circuit 50 being greater than the pressure within second circuit 52 by a predetermined amount. In this manner, when a stick and/or swing function requires a rate of fluid flow greater than an output capacity of second source 53, and the pressure within second circuit 52 begins to drop below the pressure within first circuit 50, fluid from first source 51 may be diverted to second circuit 52 by way of valve element 110. Although shown downstream of combiner valve 108, it should be appreciated that check valve 111 may alternatively be included upstream of combiner valve 108 or within combiner valve 108, as desired. When in the closed position, substantially all flow through combiner valve 108 may be blocked. When in the bidirectional open position, however, the first stream of pressurized fluid may be allowed to flow to second circuit 52 to combine with the second stream of pressurized fluid directed to control valves 62 and 63, and the second stream of pressurized fluid may be allowed to flow to first circuit 50 to combine with the first stream of pressurized fluid directed to control valves 54-58, depending on a pressure differential across combiner valve 108.

Combiner valve 108 may be modulated continuously to any position between the unidirectional open, closed, and bidirectional open positions. In this manner, a degree of the flow of pressurized fluid may be controlled based on, for example, the commanded velocities of control valve 63, the commanded flow rates of sources 51, 53, and/or the pressure differential across combiner valve 108. For example, valve element 110 may be solenoid movable to any position between the flow-passing positions and the flow-blocking position in response to a current command.

In one embodiment, hydraulic control system 150 may also include warm-up circuitry. That is, the common supply and drain passageways 66, 68 and 70, 72 of first and second circuits 50, 52, respectively, may be selectively communicated via first and second warm-up passageways 109, 113 for warm-up and/or other bypass functions. A warm-up valve 105 may be located in each of warm-up passageways 109, 113 and configured to direct fluid from common supply passageways 66 and 70 to common drain passageways 68 and 72, respectively. Each warm-up valve 105 may include a valve element movable from a closed or flow-blocking position to an open or flow-passing position. In this configuration, when warm-up valve 105 is in the open position, such as during start up of machine 10, fluid pressurized by first and second sources 51, 53 may be allowed to circulate through first and second circuits 50, 52 with very little restriction (i.e., without passing through control valve 63). After warm-up, the valve elements of warm-up valves 105 may be moved to the closed positions so that the pressure of the fluid in first and second circuits 50, 52 may build and be available for control valve 63, as described above. It is contemplated that warm-up passageways 109, 113 and warm-up valves 105 may be omitted, if desired.

Hydraulic control system 150 may also include a controller 112 in communication with operator interface device 48, first and/or second sources 51, 53, combiner valve 108, the supply and drain elements of control valves 54-63, and warm-up valves 105. It is contemplated that controller 112 may also be in communication with other components of hydraulic control system 150 such as, for example, first and second bypass elements 98, 100, straight travel valve 106, and other such components of hydraulic control system 150. Controller 112 may embody a single microprocessor or multiple microprocessors that include a means for controlling an operation of hydraulic control system 150. Numerous commercially available microprocessors can be configured to perform the functions of controller 112. It should be appreciated that controller 112 could readily be embodied in a general machine microprocessor capable of controlling numerous machine functions. Controller 112 may include a memory, a secondary storage device, a processor, and any other components for running an application. Various other circuits may be associated with controller 112 such as power supply circuitry, signal conditioning circuitry, solenoid driver circuitry, and other types of circuitry.

One or more maps relating the interface device position signal, desired actuator velocity, associated flow rates, measured pressures or pressure differentials, and/or valve element position, for hydraulic cylinders 28, 36, 38; left and right travel motors 65L, 65R; and/or swing motor 49 may be stored in the memory of controller 112. Each of these maps may include a collection of data in the form of tables, graphs, and/or equations. In one example, desired velocity and commanded flow rate may form the coordinate axis of a 2-D table for control of the first and second chamber supply elements. The commanded flow rate required to move the fluid actuators at the desired velocity and the corresponding valve element position of the appropriate supply element may be related in another separate 2-D map or together with desired velocity in a single 3-D map. It is also contemplated that desired actuator velocity may be directly related to the valve element position in a single 2-D map. Controller 112 may be configured to allow the operator to directly modify these maps and/or to select specific maps from available relationship maps stored in the memory of controller 112 to affect fluid actuator motion. It is contemplated that the maps may additionally or alternatively be automatically selectable based on modes of machine operation.

Controller 112 may be configured to receive input from operator interface device 48 and to command operation of control valves 54-63 in response to the input and the relationship maps described above. Specifically, controller 112 may receive the interface device position signal indicative of a desired velocity and reference the selected and/or modified relationship maps stored in the memory of controller 112 to determine flow rate values and/or associated positions for each of the supply and drain elements within control valves 54-63. The flow rates or positions may then be commanded of the appropriate supply and drain elements to cause filling of the first or second chambers at a rate that results in the desired work tool velocity.

Controller 112 may be configured to affect operation of combiner valve 108 in response to, for example, the commanded velocities of control valves 54-63, the commanded flow rates of sources 51, 53, and/or the pressure differential across combiner valve 108. That is, if the determined flow rates associated with the desired velocities of particular fluid actuators meet predetermined criteria, controller 112 may cause valve element 110 to move toward the unidirectional flow-passing position to supply additional pressurized fluid to second circuit 52, cause valve element 110 to move toward the bidirectional flow-passing position to supply additional pressurized fluid to first circuit 50 and/or second circuit 52, or inhibit valve element 110 from moving out of the closed position.

Figure 3:
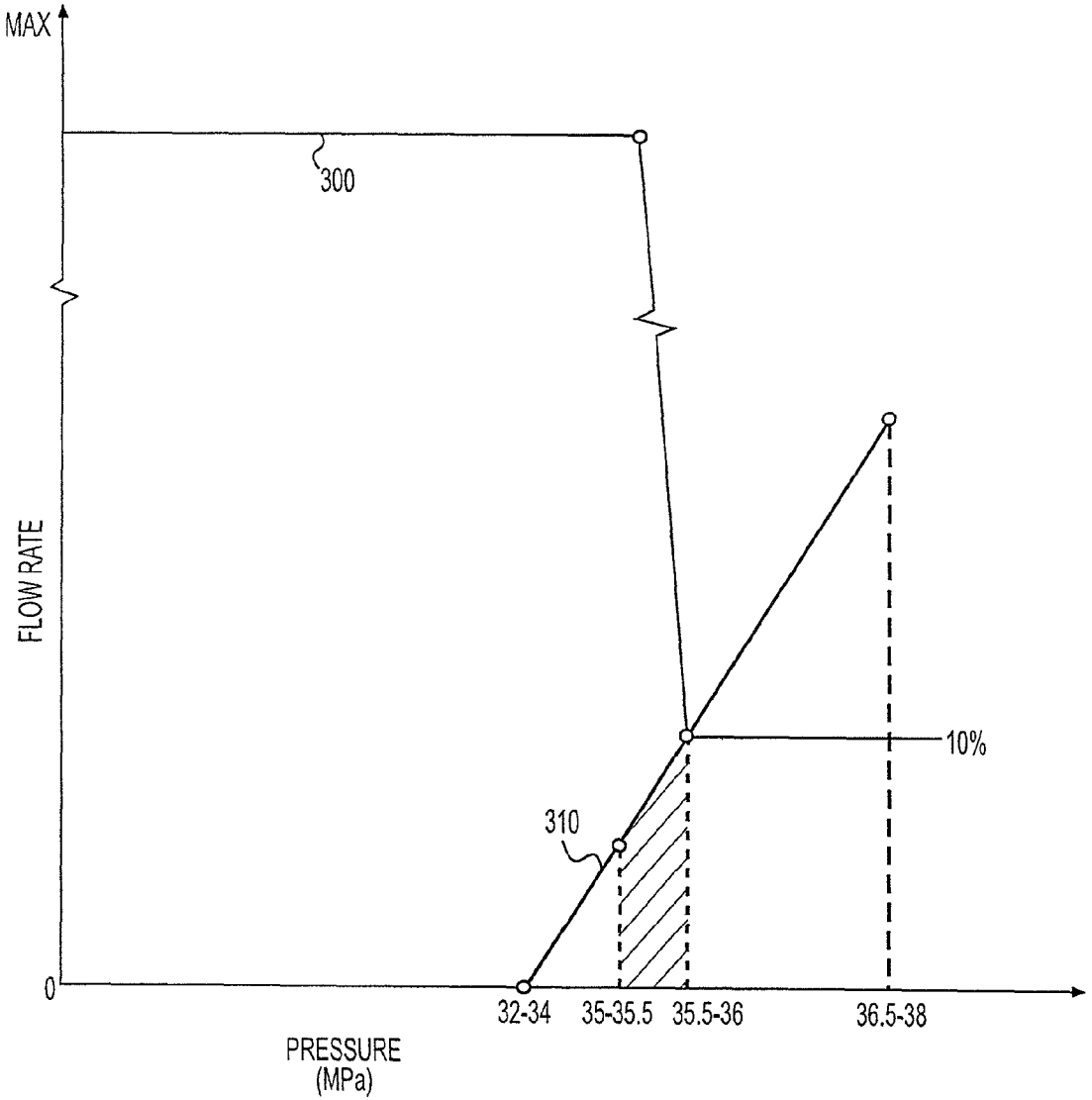
FIG. 3 is an exemplary disclosed control map that may be used by the hydraulic control system of FIG. 2.

Controller 112 may further be configured to control operation of first and/or second sources 51, 53, in conjunction with operation of common main relief valve 104, to help avoid and/or reduce the magnitude of pressure spikes within hydraulic control system 150. In particular, based on demand generated by interface device 48 and actual system pressures, as generated by one or more pressure sensors 151 (e.g., one or more sensors associated with common supply passage 66 and/or 70), controller 112 may be configured to selectively increase or decrease the displacement of first and/or second sources 51, 53. FIG. 3 illustrates an exemplary pressure control method performed by hydraulic control system 150. FIG. 3 will be discussed in the following section to further illustrate the disclosed system and its operation.

INDUSTRIAL APPLICABILITY

The disclosed control system may be applicable to any machine that hydraulically moves a work tool. The disclosed hydraulic control system may help to reduce pressure spikes that occur during movement of the work tool through coordinated control of pump displacement and relief valve opening. The disclosed hydraulic control system may also help to improve efficiencies of the associated machine by reducing unnecessary flow through the relief valve. Operation of the disclosed hydraulic control system will now be described in detail with reference to FIG. 3.

The displacement of first and/or second sources 51, 53 may be controlled based on operator demand for movement of work tool 16. That is, as the operator manipulates interface device 48, a demand for a particular movement of work tool 16 may be created that drives the displacement of first and/or second sources 51, 53 (depending on the demanded movement). As the operator moves interface device 48 by a greater amount, the demand for pressurized fluid may likewise increase and cause a corresponding increase in the displacement of first and/or second sources 51, 53.

FIG. 3 illustrates an exemplary operation of hydraulic control system 150 with two curves. In particular, a first curve 300 represents a discharge rate of pressurized fluid from first and/or seconds sources 51, 53 for a given demand for movement of work tool 16 received via interface device 48, relative to a pressure of the discharged fluid. A second curve 310 represents a flow rate of fluid spilling over main relief valve 104 relative to the pressure of the fluid.

When work tool 16 becomes loaded during movement, the pressure of hydraulic control system 150 may increase. And, as shown in FIG. 3, as long as the pressure within hydraulic control system 150 stays below a first threshold pressure, operation may continue normally. That is, first and/or second sources 51, 53 may continue to discharge fluid at the same rate (i.e., at the rate corresponding to the given demand) as the pressure increases, and common main relief valve 104 may remain in the fully closed position to block fluid flow to tank 64. Operation may continue in this manner as long as system pressures are below a mechanical relief opening point of main relief valve 104. In the disclosed embodiment, the mechanical relief opening point of main relief valve 104 may be set at about 32-34 MPa. It should be noted that the mechanical relief opening point may be set to a variety of pressure levels, depending on machine 10 and its applications.

As the pressure of hydraulic control system 150 reaches and/or surpasses the mechanical relief opening point, common main relief valve 104 may begin to move away from the fully closed position and start to dump fluid into tank 64 (i.e., fluid discharged from first and/or second sources 51, 53 may be diverted away from work tool 16 and into tank 64) in an attempt to reduce system pressures. This movement of common main relief valve 104 may provide tactile and/or audible signals to the operator of machine 10 that system pressures are approaching their maximum allowable levels, without yet causing a significant reduction in work tool force or controllability. In particular, the speed of work tool 16 may start to decrease gradually as main relief valve 104 starts to open because less flow may be available to move work tool 16, and the noise of machine 10 (e.g., engine noise) may reduce some as the corresponding flow rate reduces. Because the pressure within hydraulic control system 150 may remain the same and/or increase at this time, however, the force of work tool 16 may remain substantially unchanged or even increase. This feedback (i.e., the reduction in tool speed and/or the reduction in engine noise) may allow the operator to adjust use of machine 10 before further and more dramatic intervention is implemented. The output of first and/or second sources 51, 53 may remain substantially unchanged at this point in time, relative to a given demand for fluid received from interface device 48. This relationship may be exhibited by the relatively flat slope of the flow rate vs. pressure curve 300 shown in FIG. 3.

Common main relief valve 104 may continue to open relative to an increasing system pressure such that a proportionally increasing amount of pressurized fluid may be dumped to tank 64. This opening relationship may be exhibited by the relatively constant slope of the flow rate vs. pressure curve 310 shown in FIG. 3. However, at a second threshold pressure, controller 112 may be configured to selectively begin decreasing the displacement of first and/or second sources 51, 53 (depending on which source(s) is currently supplying the high-pressure fluid moving work tool 16) for the given demand. This relationship may be exhibited by the negative slope of the flow rate vs. pressure curve 300. The second threshold pressure may be greater than the first threshold pressure, but less than the pressure required to move common main relief valve 104 to its fully open position. In the disclosed exemplary embodiment, the second pressure threshold may be about 35-35.5 MPa, although other pressure ranges may be utilized, as desired.

Controller 112 may continue to reduce the displacement of first and/or second sources 51, 53 as the pressure of hydraulic control system 150 increases. This reduction may result in less fluid flow being available to move work tool 16 and, hence slower and slower movements of work tool 16. The slowing down of work tool 16 (and corresponding noise reduction) may provide further and more exaggerated feedback to the operator that system levels are nearing their limits and the operator should take evasive action. In addition, the reduced output of first and/or second sources 51, 53 may reduce a rate of pressure increase and corresponding rate of fluid dumping into tank 64 for an increasing load, thereby improving an efficiency and controllability of machine 10.

In some embodiments, the de-stroking of first and/or second sources 51, 53, may be limited. That is, controller 112 may be configured to destroke first and/or second sources 51, 53 only to a minimum amount that still allows some flow to be discharged by first and/or second sources 51, 53. For example, the minimum amount may still allow for about 10% of a maximum flow to be discharged from first and/or second sources 51, 53. In this manner, the operator may still be able to control the movements of work tool 16, even if at reduced speeds.

At some point in time, as pressures within hydraulic control system 150 continue to increases, first curve 300 may eventually cross second curve 310. This point may correspond with the full flow of fluid discharged from first and/or second sources 51, 53 being dumped over main relief valve 104 into tank 64. When this happens, no flow may be left to move work tool 16 and work tool 16 may stop moving altogether. In the disclosed embodiment, this point may coincide with a system pressure of about 35.5-36 MPa.

The stroke-reducing functionality of controller 112 may be selectively overridden by the operator. In particular, controller 112 may be caused to enter a high-load mode of operation, wherein stroke reductions of first and/or second sources 51, 53 may be inhibited. When the high-load mode of operation has been requested by the operator, only common main relief valve 104 may be used to inhibit the formation of damaging pressure spikes, and the overall maximum pressure of hydraulic control system 150 may be allowed to increase all the way to a hydro-mechanical relief set point, which may be set between about 36.5-38 MPa, allowing for a corresponding force increase of work tool 16. Operation in the high-load mode may be requested by way of interface device 48 or another device within operator station 22.

Several benefits may be associated with the disclosed hydraulic control system. First, hydraulic control system 150 may be protected from damaging pressure spikes. Second, this methodology may result in machine energy savings without sacrificing machine performance.

It will be apparent to those skilled in the art that various modifications and variations can be made to the disclosed hydraulic control system. Other embodiments will be apparent to those skilled in the art from consideration of the specification and practice of the disclosed hydraulic control system. It is intended that the specification and examples be considered as exemplary only, with a true scope being indicated by the following claims and their equivalents.

What is claimed is:

1. A hydraulic control system, comprising:

a tank;

a pump configured to draw fluid from the tank and pressurize the fluid;

an actuator;

a control valve configured to direct fluid from the pump to the actuator and from the actuator to the tank to move the actuator;

a main relief valve movable away from a closed position to pass pressurized fluid to the tank when a pressure of the fluid at the actuator exceeds a first threshold pressure; and a controller in communication with the pump and configured to selectively reduce a displacement of the pump after the main relief valve has moved away from the closed position when the pressure of the fluid at the actuator exceeds a second threshold pressure.

2. The hydraulic control system of claim 1, wherein:

the first threshold pressure is 32-34 MPa; and the second threshold pressure is 35-35.5 MPa.

3. The hydraulic control system of claim 2, wherein the main relief valve is configured to move to a fully opened position when the pressure of the fluid at the actuator reaches a third threshold pressure higher than the second threshold pressure.

4. The hydraulic control system of claim 3, wherein the third threshold pressure is 36.5-38 MPa.

5. The hydraulic control system of claim 3, wherein the controller is configured to stop reducing the displacement of the pump regardless of the pressure of the fluid directed to the actuator during a high-load mode of operation.

6. The hydraulic control system of claim 5, wherein:

the controller is configured to receive input indicative of a desire to enter the high-load mode of operation; and the high-load mode of operation is triggered based on input.

7. The hydraulic control system of claim 1, wherein the controller is further configured to limit displacement reducing of the pump based on the pressure of the fluid to a minimum level greater than zero.

8. The hydraulic control system of claim 7, wherein the minimum level is 10% of a maximum flow rate.

9. The hydraulic control system of claim 1, wherein:

the main relief valve is a mechanically actuated valve;

the hydraulic control system further includes a pressure sensor configured to generate a signal indicative of a pressure of fluid at the actuator; and the controller is configured to reduce the displacement of the pump based on the signal.

10. The hydraulic control system of claim 1, wherein the main relief valve is configured to move further away from the closed position and pass a greater amount of pressurized fluid to the tank as the pressure of the fluid directed to the actuator increases during displacement reduction of the pump.

11. The hydraulic control system of claim 10, wherein movement of the main relief valve is substantially linear relative to the pressure of the fluid directed to the actuator.

12. The hydraulic control system of claim 11, wherein the controller is configured to reduce the displacement of the pump linearly relative to an increasing pressure of the fluid directed to the actuator.

13. The hydraulic control system of claim 1, wherein:

the actuator is a first actuator;

the pump is a first pump;

the control valve is a first control valve;

the hydraulic control system further includes:

a second actuator;

a second pump configured to draw fluid from the tank and pressurize the fluid; and a second control valve configured to direct fluid from the first and/or second pumps to the second actuator;

the main relief valve is movable away from the closed position to pass pressurized fluid to the tank when a pressure of the fluid directed to the second actuator exceeds the first threshold pressure; and the controller is further configured to selectively reduce the displacement of the second pump independent of or simultaneous with displacement reduction of the first pump after the main relief valve has moved away from the closed position when the pressure of the fluid directed to the first or second actuator exceeds the second threshold pressure.

14. A method of operating a hydraulic control system, comprising:

pressurizing a fluid with a pump;

directing pressurized fluid from the pump to an actuator and draining fluid from the actuator to move the actuator;

moving a main relief valve away from a closed position when a pressure of fluid at the actuator exceeds a first threshold pressure; and reducing a displacement of the pump after the main relief valve has moved away from the closed position when the pressure of the fluid at the actuator exceeds a second threshold pressure.

15. The method of claim 14, wherein:

the first threshold pressure is 32-34 MPa; and the second threshold pressure is 35-35.5 MPa.

16. The method of claim 15, further including moving the main relief valve to a fully opened position when the pressure of the fluid at the actuator reaches a third threshold pressure higher than the second threshold pressure.

17. The method of claim 16, wherein the third threshold pressure is 36.5-38 MPa.

18. The method of claim 14, further including inhibiting displacement reduction of the pump during a high-load mode of operation requested by an operator.

19. The method of claim 14, further including limiting displacement reduction of the pump based on the pressure of the fluid to 10% of a maximum flow rate.

20. A machine, comprising:

a frame;

a work tool operatively connected to the frame;

a tank;

a plurality of pumps configured to draw fluid from the tank and pressurize the fluid;

a plurality of actuators disposed between the frame and the work tool;

at least one control valve configured to direct fluid from the plurality of pumps to the plurality of actuators and from the plurality of actuators to the tank to move the work tool;

a main relief valve movable away from a closed position to pass pressurized fluid to the tank when a pressure of the fluid at the plurality of actuators exceeds a first threshold pressure; and a controller in communication with the plurality of pumps and configured to:

selectively reduce a displacement of at least one of the plurality of pumps after the main relief valve has moved away from the closed position when the pressure of the fluid directed to at least one of the plurality of actuators exceeds a second threshold pressure;

limit displacement reduction of the plurality of pumps based on the pressure of the fluid to 10% of a maximum flow rate;

move the main relief valve to a fully opened position when the pressure of the fluid at the plurality of actuators reaches a third threshold pressure higher than the second threshold pressure; and inhibit displacement reduction of the plurality of pumps during a high-load mode of operation requested by an operator.

* * * * *